US012564796B2

(12) United States Patent
Sunwoo

(10) Patent No.: US 12,564,796 B2
(45) Date of Patent: Mar. 3, 2026

(54) CAR RACING SYSTEM

(71) Applicant: Yoon Sunwoo, Seoul (KR)

(72) Inventor: Yoon Sunwoo, Seoul (KR)

( * ) Notice: Subject to any disclaimer, the term of this patent is extended or adjusted under 35 U.S.C. 154(b) by 261 days.

(21) Appl. No.: 18/267,090

(22) PCT Filed: Dec. 10, 2021

(86) PCT No.: PCT/KR2021/018713

§ 371 (c)(1),
(2) Date: Jun. 13, 2023

(87) PCT Pub. No.: WO2022/131688

PCT Pub. Date: Jun. 23, 2022

(65) Prior Publication Data

US 2024/0009584 A1 Jan. 11, 2024

(30) Foreign Application Priority Data

Dec. 14, 2020 (KR) ..... 10-2020-0174761
Apr. 1, 2021 (KR) ..... 10-2021-0042700

(51) Int. Cl.
*A63H 18/02* (2006.01)
*A63H 30/04* (2006.01)

(52) U.S. Cl.
CPC ..... *A63H 18/026* (2013.01); *A63H 30/04* (2013.01)

(58) Field of Classification Search
CPC ..... A63H 18/00–16
See application file for complete search history.

(56) References Cited

U.S. PATENT DOCUMENTS 1,846,823 A * 2/1932 Westberg ..... A63H 29/02 446/437
2,757,482 A * 8/1956 Brown ..... A63H 17/02 446/6
3,000,137 A * 9/1961 Vine ..... A63H 17/02 446/6

(Continued)

FOREIGN PATENT DOCUMENTS

KR 10-1999-0068385 A 9/1999
KR 10-2007-0101487 A 10/2007

(Continued)

OTHER PUBLICATIONS

Machine Translation of KR-20150099152A, uploaded Apr. 25, 2025, Espacenet, 8 pages.*

(Continued)

*Primary Examiner* — Nicholas J. Weiss
*Assistant Examiner* — Matthew B Stanczak
(74) *Attorney, Agent, or Firm* — Revolution IP, PLLC

(57) ABSTRACT

The present invention discloses a car racing system includes: a lane configured for car racing: a car includes: a first magnet for attracting a second magnet; the second magnet configured at one end of a second locking device so that the second locking device operates while being attracted by the first magnet; the second locking device for releasing a first locking device by that the second magnet is attracted to the first magnet; the first locking device for operating the car to be lifted and be departed from the lane by being released by the second locking device; and a remote controller for controlling the car.

4 Claims, 11 Drawing Sheets

(56) References Cited

U.S. PATENT DOCUMENTS 3,176,429 A * 4/1965 Brown ..... A63H 17/02 446/6
3,711,991 A * 1/1973 Orfei ..... A63H 33/26 446/131
3,734,500 A * 5/1973 Cooper ..... A63H 17/02 446/6
3,892,086 A * 7/1975 Gay ..... A63H 17/02 446/486
4,068,392 A * 1/1978 Montgomery ..... G09B 23/10 434/301
4,147,351 A * 4/1979 Saito ..... A63H 18/08 446/446
4,295,292 A * 10/1981 Fitzgerald ..... A63F 9/14 446/6
4,466,214 A * 8/1984 Kulesza ..... A63H 17/02 446/437
4,508,521 A * 4/1985 Klimpert ..... A63H 3/18 446/4
4,571,197 A * 2/1986 Kulesza ..... A63H 17/02 446/6
4,715,602 A 12/1987 May et al.
4,990,117 A * 2/1991 Yonezawa ..... A63H 18/10 446/444
4,993,985 A * 2/1991 Bass ..... A63H 33/26 446/133
5,100,153 A * 3/1992 Welte ..... A63F 9/02 273/357
5,609,510 A * 3/1997 Stubenfoll ..... A63H 17/26 446/470
5,702,107 A * 12/1997 Novak ..... A63H 17/02 446/6
5,713,783 A * 2/1998 Szoke ..... A63H 17/02 446/6
5,928,058 A * 7/1999 Francis ..... A63H 17/36 446/457
5,931,714 A * 8/1999 Johnson ..... A63H 18/10 446/136
6,435,929 B1 * 8/2002 Halford ..... A63H 18/00 446/6
6,439,955 B1 * 8/2002 Feketo ..... A63H 17/00 446/435
6,450,856 B1 * 9/2002 Aldred ..... A63H 33/3044 446/454
6,672,937 B1 * 1/2004 Motosko ..... A63H 17/26 446/431
6,780,077 B2 * 8/2004 Baumgartner ..... A63H 30/04 446/454
8,900,031 B2 * 12/2014 Benedict ..... A63H 17/40 446/437
8,905,815 B2 * 12/2014 Keating ..... A63H 18/16 446/454
9,573,072 B2 * 2/2017 Cai ..... A63H 17/02
2006/0128267 A1 * 6/2006 Yamaguchi ..... A63H 18/08 446/454
2011/0171878 A1 * 7/2011 Ichikawa ..... A63H 30/04 446/454
2018/0104609 A1 * 4/2018 Musliner ..... A63H 18/021
2024/0009584 A1 * 1/2024 Sunwoo ..... A63H 30/04

FOREIGN PATENT DOCUMENTS

KR 10-2013-0108940 A 10/2013
KR 20150099152 A * 8/2015 ..... A63H 17/00
KR 10-2018-0063656 A 6/2018
KR 10-2018-0086780 A 8/2018

OTHER PUBLICATIONS

International Search Report for PCT/KR2021/018713 mailed Apr. 8, 2022 from Korean Intellectual Property Office.

* cited by examiner

[Figure 1]
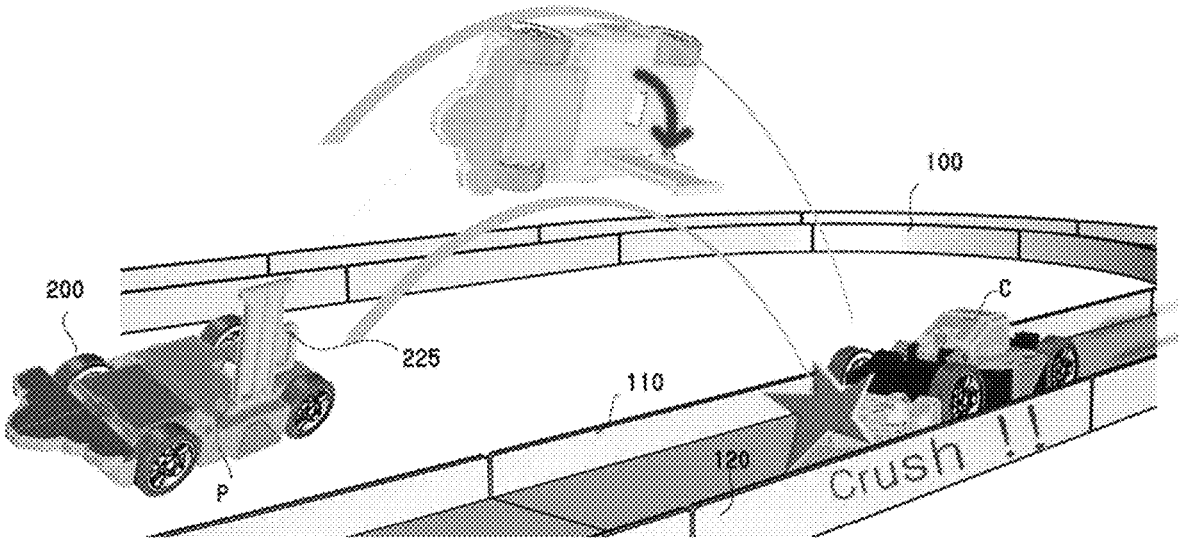
[Figure 2]
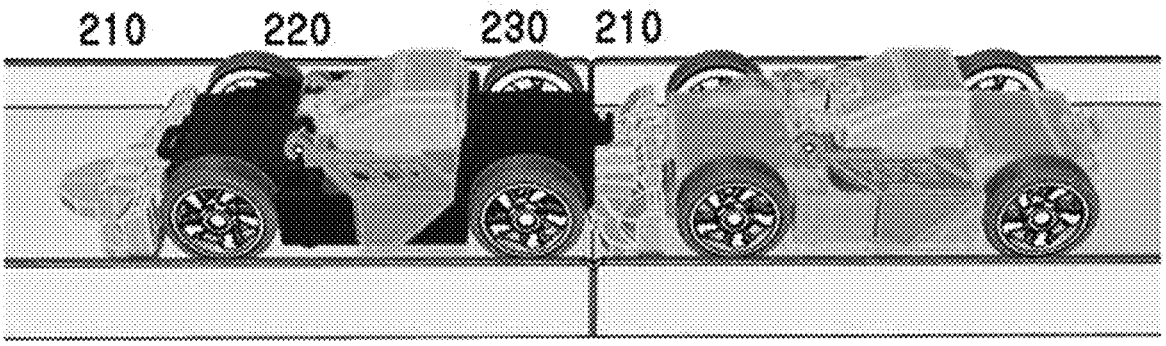

[Figure 3]
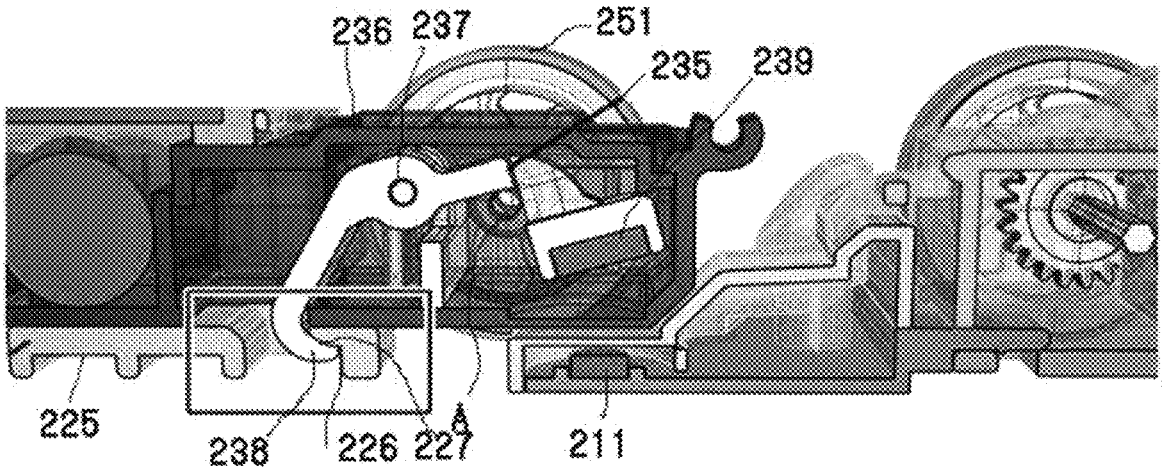
[Figure 4]
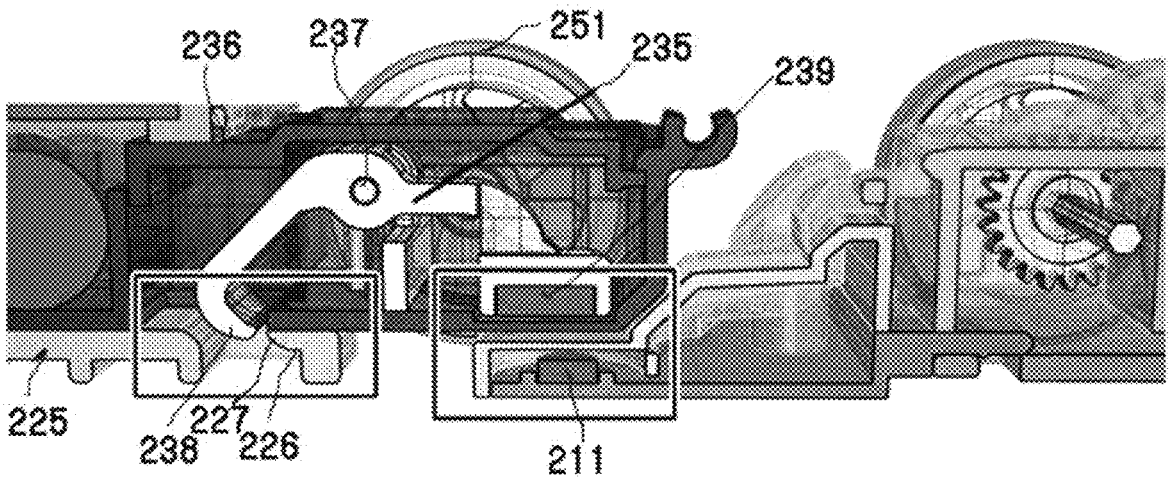

[Figure 5]
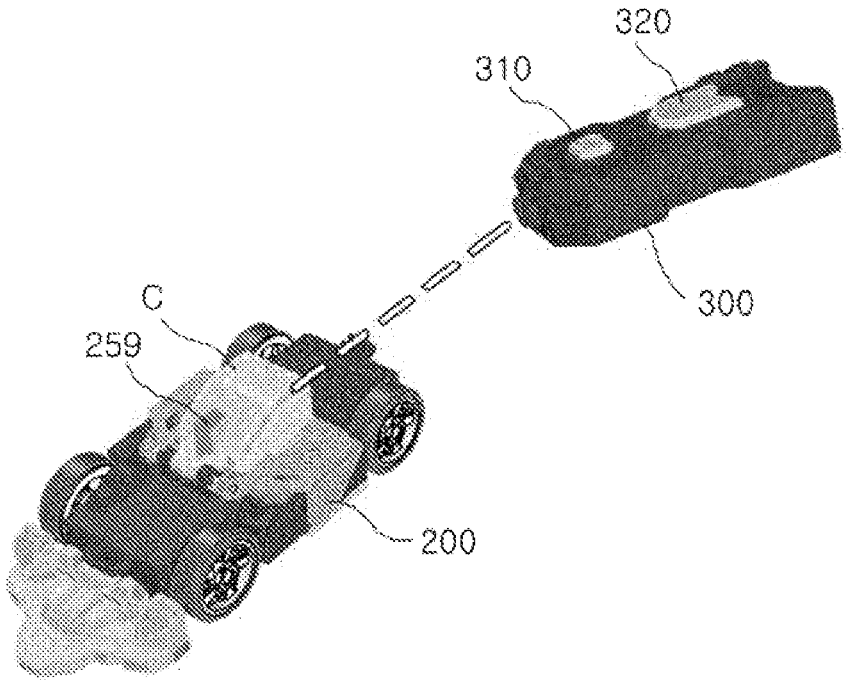

[Figure 6]
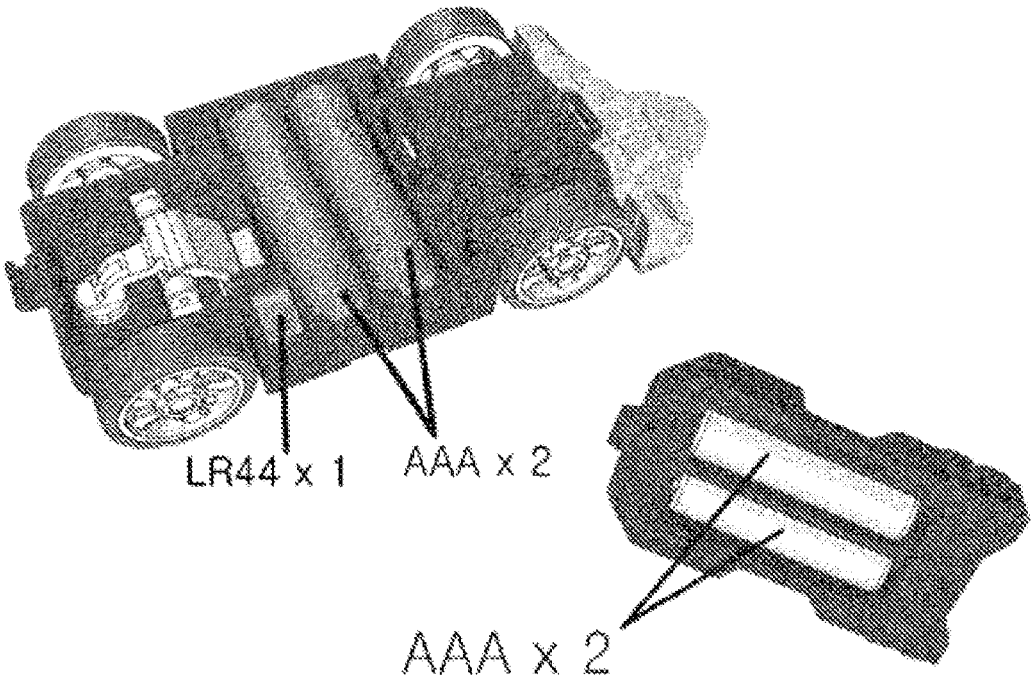
[Figure 7]
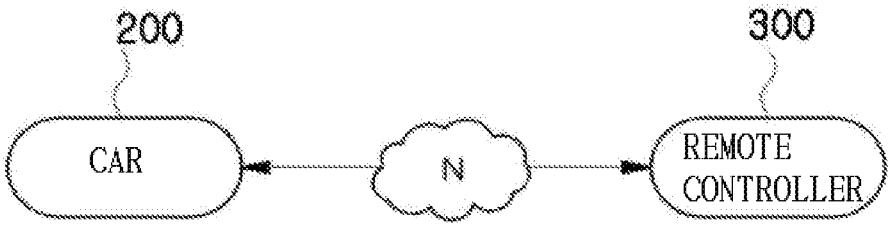

[Figure 8]
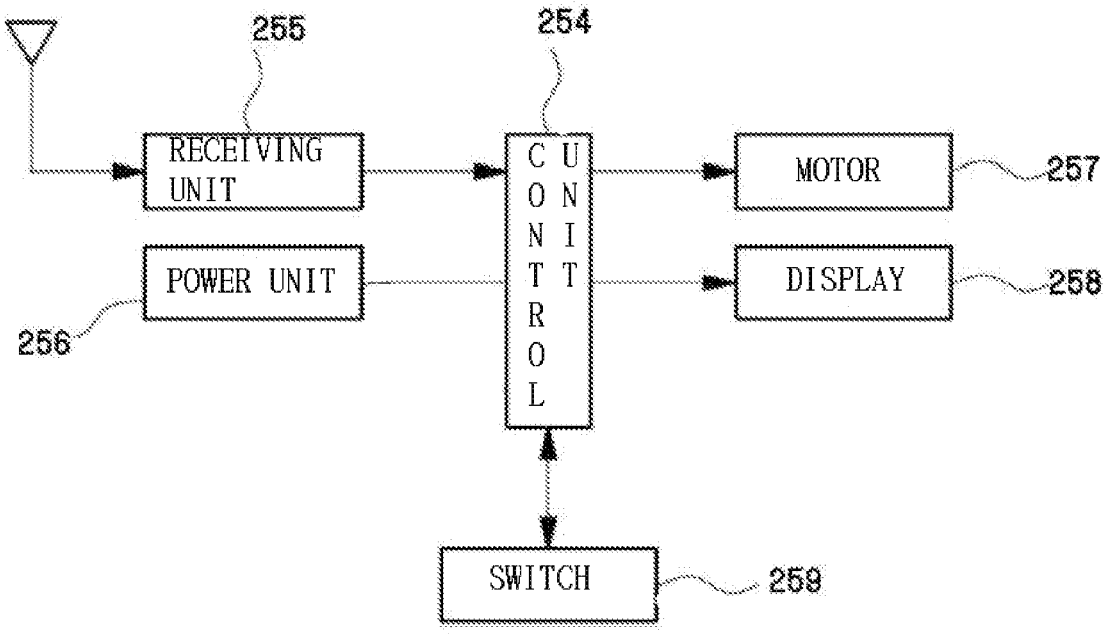

[Figure 9]
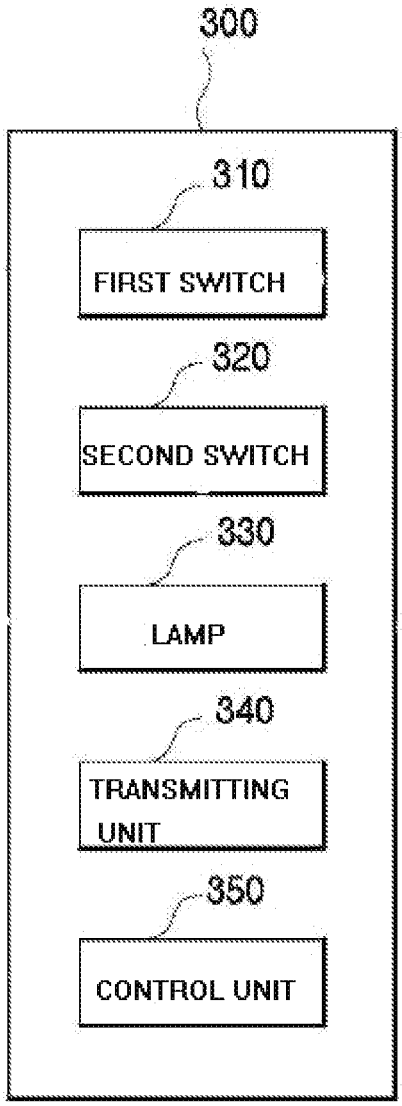

[Figure 10]
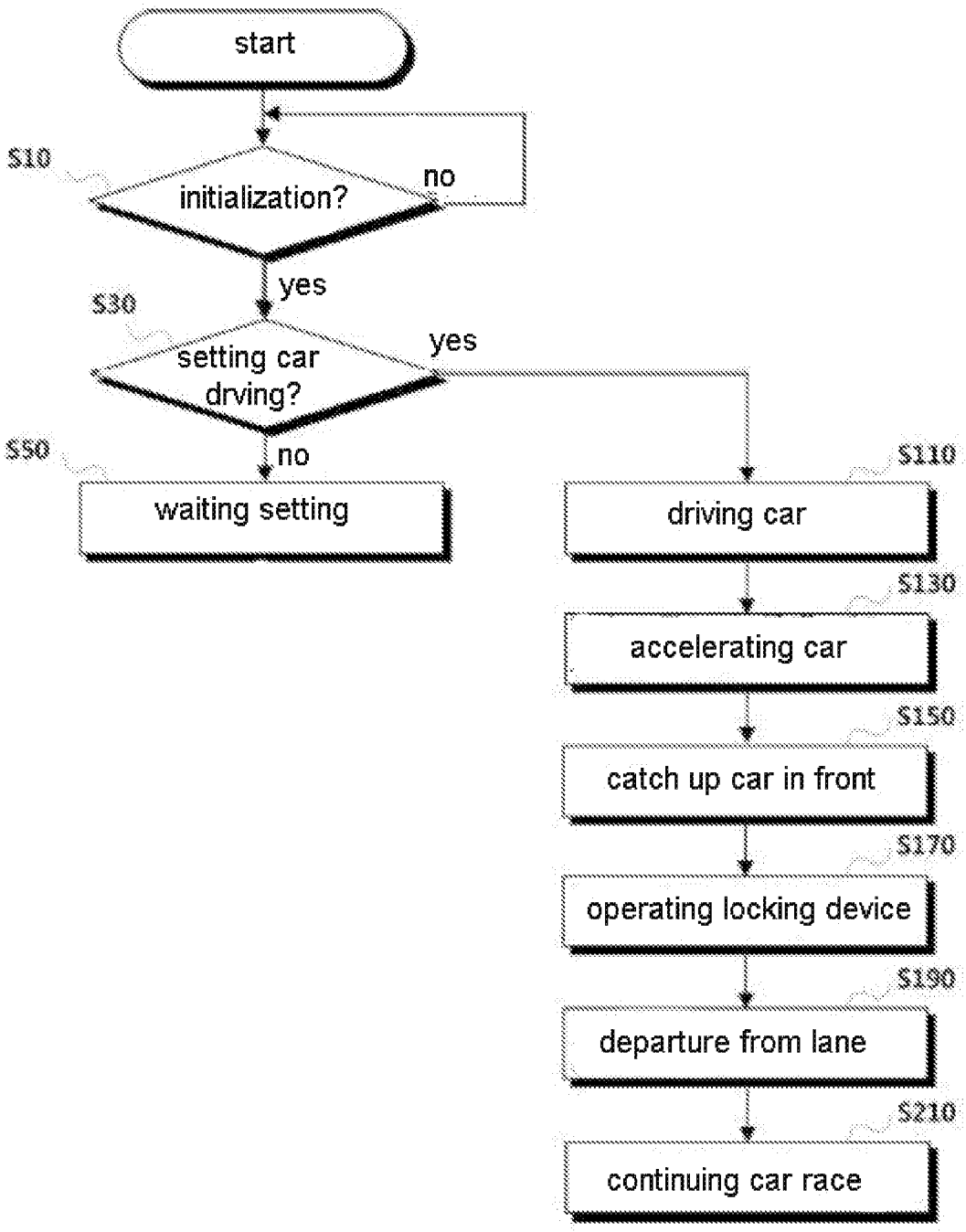

[Figure 11]
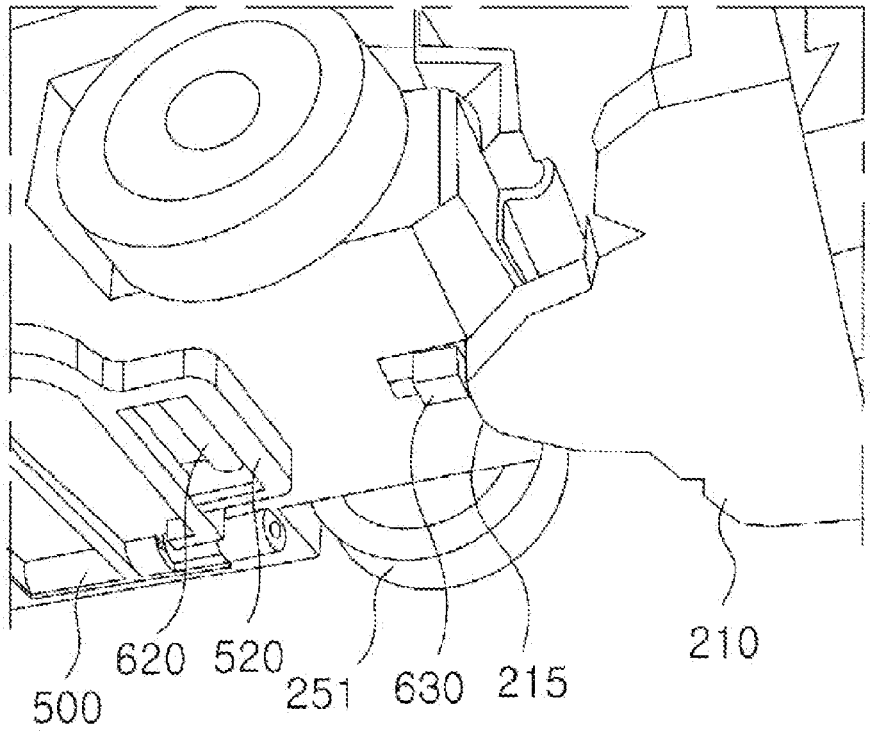

[Figure 12]
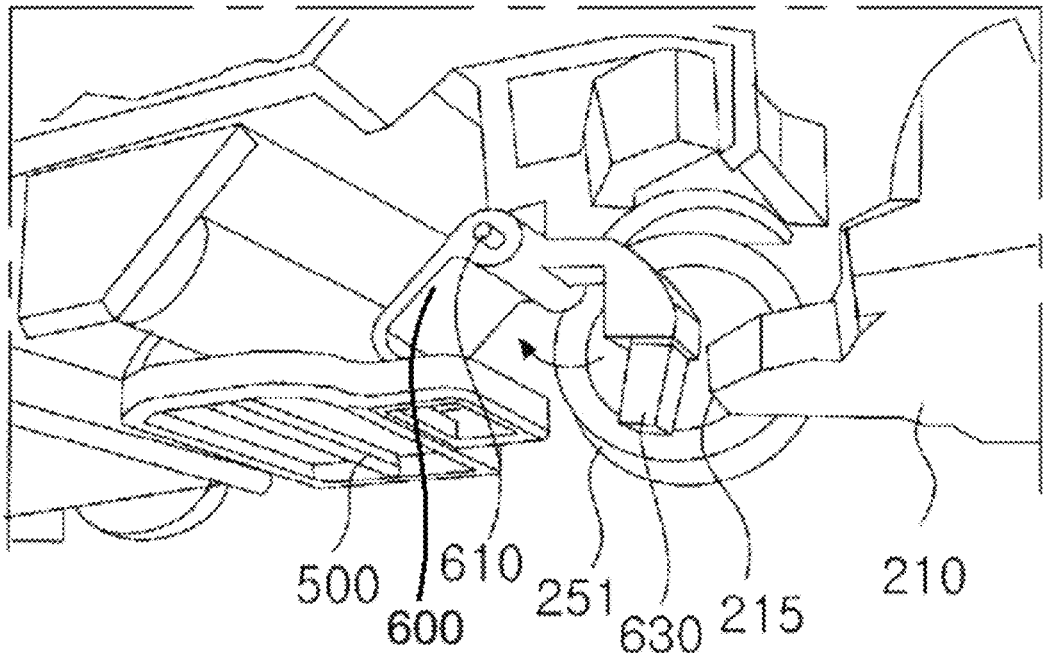

[Figure 13]
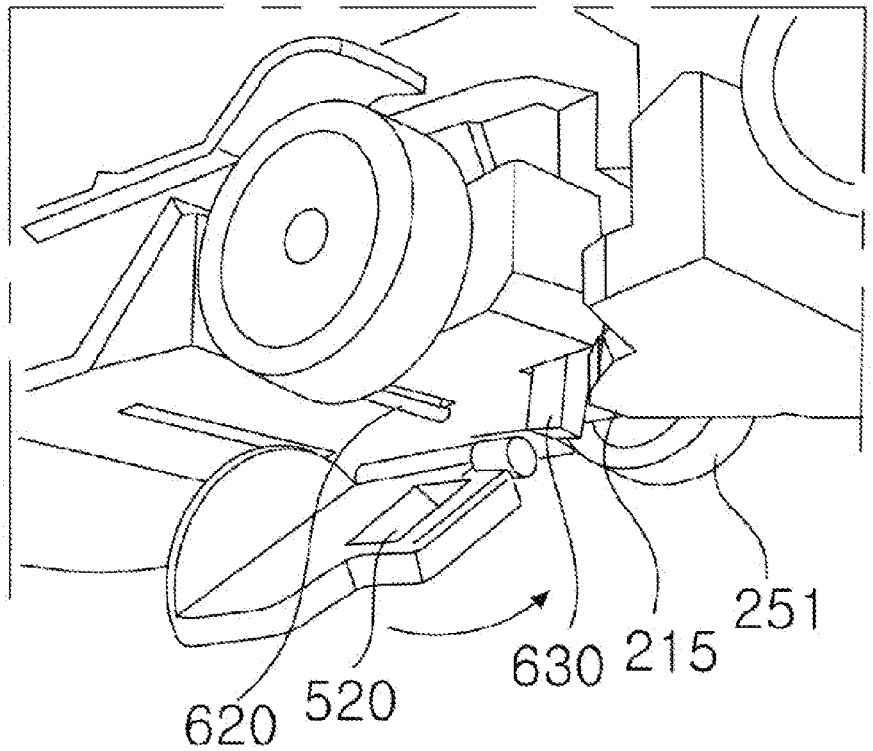

[Figure 14]
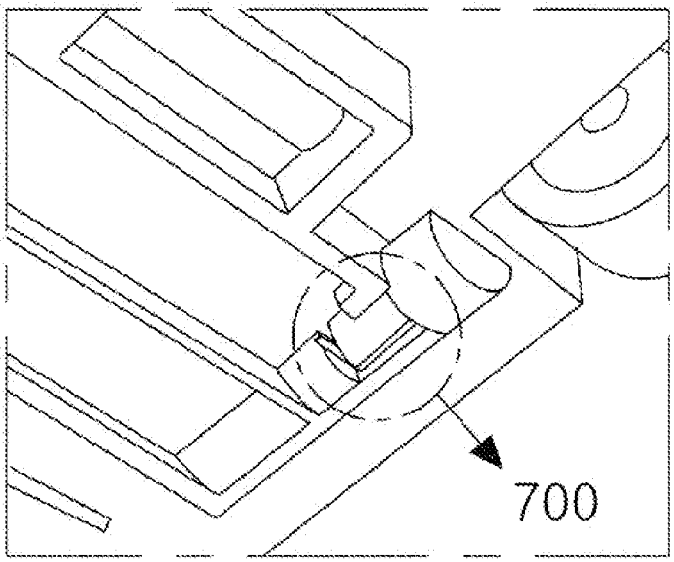

CAR RACING SYSTEM

TECHNICAL FIELD

The present invention relates to a car racing system.

In particularly, the present invention relates to a car racing system that a player can enjoy a car racing game realistic and thrilling like a real car race using a controller (remote controller) and a car lets the other car out of a lane by accelerating of the car.

BACKGROUND

Korean Patent Laid-open Publication No. 10-1999-0068385 relates to a car racing game system, in which the volume is finely adjusted according to the degree to which the player pulls the trigger through a control device on a lane designed and manufactured in a specific shape and length, and the finely adjusted volume is input as a digitally converted pulse value to the AD converter and the electronic transmission, and DC power is properly supplied so that power is properly supplied to the vehicle that can run on the lane. Therefore, it is possible to adjust the driving of the car by fine adjustment to the same extent as the actual driving by the driver, and when the trigger is released, the instantaneous reverse current is supplied to perform the powerful braking function, so the car racing game is progressed realistic and thrilling.

In addition, the game can be further enjoyable by installing a first place display means and a maximum speed measuring means in the system, and a means for arranging cars after the game is also installed so that the game can be played even if other players continuously participate and the system can be configured to be durable, so reducing the failure rate of the device and doubling the lifespan.

However, the conventional car racing system as described above is a technology related to simple car racing, and it is not possible to produce a car accident or damage that occurs during actual car racing, so the development of more exciting games is required.

DISCLOSURE

Technical Problem

An object of the present invention is to provide a car racing system that a player can enjoy a car racing game realistic and thrilling like a real car race using a controller (remote controller) and a car lets the other car out of a lane by accelerating of the car.

The technical problems to be achieved by the present invention are not limited to the above-mentioned technical problems, and other technical problems not mentioned can be clearly understood by those skilled in the art from the description below.

Technical Solution

In order to achieve the above objects, the present invention provides car racing system comprises:

A lane configured for car racing:

A car includes:

a first magnet for attracting a second magnet;

the second magnet configured at one end of a second locking device so that the second locking device operates while being attracted by the first magnet;

the second locking device for releasing a first locking device by that the second magnet is attracted to the first magnet;

the first locking device for operating the car to be lifted and be departed from the lane by being released by the second locking device; and a remote controller for controlling the car.

The first locking device is coupled to a certain portion of the bottom surface of the vehicle body through a spring hinge to enable elastic movement, and the first locking portion is configured to be locked or released by the second locking device.

The second locking device is accommodated in a body in which a certain space is formed, and moves through a shaft formed in the body, and at one end a second locking portion is formed to be locked or released by the first locking portion of the first locking device, and the at the other end the second magnet is formed to react with the first magnet.

The car includes a control unit that processes signals from the remote controller to increase the rotational speed of the motor and controls the race as a whole; the receiving unit for receiving the car driving start signal; the lamp flashing signal and the car acceleration signal from the remote controller and inputting to the control unit; a power supply unit for supplying the power to the control unit and supplying additional power to increase the speed of the motor; a motor for rotating to enable driving the car on the lane; a display unit for displaying the driving state of the car; and a switch for setting the car driving state displaying through the display unit.

The remote controller includes a first switch that sets the blinking number (pattern) of the remote control lamp to be the same as the blinking number of the lamp by the switch configured in the car; and a second switch for being manipulated an operation for starting driving of the car and an operation for accelerating the car.

In order to achieve the above objects, the present invention provides car racing system comprises:

lanes configured for car racing:

a third locking device configured at the bottom of the second part of the car body, which is locked or unlocked by the fourth locking device and unfolds at a predetermined angle so that the car is lifted upward and departed from the lane;

The third locking device includes a third locking portion that is locked or unlocked by the fourth locking device, and the fourth locking device includes a fourth locking portion that locks or unlocks the third locking device, and the fourth locking device.

Effect of the Invention

According to the car racing system of the present invention, a a player can enjoy a car racing game realistic and thrilling like a real car race using a controller (remote controller) and a car lets the other car out of a lane by accelerating of the car.

BRIEF DESCRIPTION OF THE DRAWINGS

FIG. 1 is a principle view of a car racing system according to an embodiment of the present invention.

FIG. 2 illustrates a car running behind catching up with a car running in front according to an embodiment of the present invention.

FIG. 3 is a structure of a locking device according to a first embodiment of the present invention, showing a locked state.

FIG. 4 is structure of a locking device according to a first embodiment of the present invention, showing an unlocked state.

FIG. 5 is a view showing that a car is controlled by a remote controller according to an embodiment of the present invention.

FIG. 6 is a configuration diagram of a power supply unit of a car racing system according to an embodiment of the present invention.

FIG. 7 is a control block diagram of a car racing system according to an embodiment of the present invention.

FIG. 8 is a car control block diagram of a car racing system according to an embodiment of the present invention.

FIG. 9 is a control block diagram of a remote controller of a car racing system according to an embodiment of the present invention.

FIG. 10 is an operation flowchart of a car racing system according to an embodiment of the present invention.

FIG. 11 is a structure of a locking device according to a second embodiment of the present invention, showing a locked state.

FIG. 12 is a structure of a locking device according to a second embodiment of the present invention, showing a unlocked state.

FIG. 13 is a view showing a state in which a third locking device is rotated by elasticity by that the locking device according to a second embodiment of the present invention is unlocked.

FIG. 14 is a view showing a spring member causing rotation of a third locking device by that the locking device according to the second embodiment of the present invention is unlocked.

BEST MODE

First Embodiment

As shown in FIGS. 1, 5 and 7 respectively, a car racing system of the present invention comprises a lane 100, a car 200, and a remote controller 300. A plurality of cars 200 drive on the lane 100 competing for speed with each other. The plurality of cars 200 are out of the lane 100 during racing by a predetermined condition, and the car that remains until the end is judged to be the winner.

Departure of the car 200 from the lane 100 is caused by the lower portion of the car 200, more precisely, a first locking device 225 disposed in a second part 220 being unlocked under a predetermined condition, thereby losing the center of gravity.

As described above, the system of the present invention includes the lane 100, the car (racing car) 200, and the remote controller 300.

As shown in FIG. 1, the lane 100 has a curved shape, and has an optimal state for the car 200 to drive.

The lane 100 has guides 110 and 120 having a predetermined height from the floor so that the car 200 drives without departing from the lane 100. However, it is necessary to set the heights of the guides 110 and 120 so that the car in front can be easily departed from the lane 100 when the car driving behind catches up with the car driving in front. That is, when a first locking device disposed in the lower part of the car is operated (unfolding operation) at a predetermined angle, such as a right angle, it is designed so that the height of the car when the first locking device was released exceeds the height of the guides 110 and 120, so that it can be easily departed from the lane 100.

The car 200 is designed to have a width and height to not exceed from the width and height of the guides 110 and 120 of the lane 100. The car body includes a first part 210, a second part 220 and a third part 230 as shown in FIG. 2. The first part 210, the second part 220 and the third part 230 are divided for convenience in order to explain the principle in which the car driving on the lane 100 departs from the lane 100 by the operation of the locking device.

The first part 210 is the frontmost part of the car 200, and comprises the first magnet 211 on its lower surface.

The first magnet 211 reacts to induce the operation of the first and second locking devices configured in the other car by reacting with a second magnet configured in the other car. In the above, reacting with the second magnet of the other car may be attraction due to opposite polarity.

The first magnet 211 is fixed to a predetermined space formed below the first part 210 by an appropriate coupling means. The coupling means is not limited to specific types such as tapes and screws.

The second part 220 is a middle part of the car 200, and comprises the first locking device 225.

The first locking device 225 is configured on the bottom surface of the car body. The first locking device 225 is in close contact with the bottom surface of the car body, and when it is unlocked by the first magnet 211 of the other car it operates elastically at a predetermined angle. Therefore, the car body is lifted upward and loses the center of gravity, causing the car to departure from the lane 100.

In order to enable elastic operation, the first locking device 225 may be coupled to a certain portion of the bottom surface of the car body via a spring hinge P as shown in FIG. 1. The first locking device 225 is unlocked from the state that it is elastically coupled to a certain lower part of the second part 220 by the spring hinge P. and then the first locking device 225 is unfolded by a right angle (rotational movement) and the car body is lifted upward from the lane 100. Therefore, the body of a car driving loses its center of gravity and tilts and is departed from the lane 100.

The spring hinge P is an example, and there is no limit any construction if the first locking device 225 is elastically coupled to the bottom surface of the car body of the second part 220, and if the first locking device 225 can be operated by a predetermined angle.

The first locking device 225 has a size that does not exceed the width (left and right width) of the car 200, and it has a first locking portion 226 having a "¬" shape that is locked or released by the second locking device 235.

The third part 230 is the rear part of the car body of the car 200, and has the second locking device 235.

As shown in FIGS. 3 and 4, the second locking device 235 is formed on the body 236, and the body 236 is configured to be separated from the bottom surface of the lane 100 so as not to interfere with the driving of the car.

The body 236 has a space to accommodate the second locking device 235, and can be partially located between the two rear wheels 251. In this case, it is preferable to form the hole on the body 236 to be passed the shaft 237 connecting two rear wheels 251.

That is, the shaft 237 connecting the two rear wheels 251 is connected through the hole of the body 236, so that the rotational driving of the wheels is not hindered.

The second locking device 235 operates through a shaft 237 formed in the body 236. At one end of the second locking device 235 a second locking portion 238 is configured to be locked or released from the first locking portion 226 of the first locking device 225, and at the other end a second magnet 239 is configured to be reacted with a first magnet 211 in the other car.

The second locking part 238 is securely fixed (locked) to the first locking part 226 when a car driving behind does not approach within a certain distance. When a car driving behind approaches within a certain distance, the locking release is easily performed by the reaction of the first magnet 211 and the second magnet 239.

That is, the second locking part 238 has a shape having a certain curved surface so as to be smoothly unlocked from the first locking part 226, and the first locking part 226 has a configuration that allows the second locking part 228 to be released smoothly. Accordingly, the first locking portion 226 needs to be formed with a curved portion 227 as shown in FIG. 3.

In addition to the above components, the car 200 includes a control box C for receiving a control signal transmitted from the remote controller 300 and controlling the driving, acceleration, and driving state display of the car 200, as shown in FIG. 5.

In addition, as shown in FIG. 8, the car 200 includes a control unit 254 that processes signals from the remote controller 300 to increase the rotational speed of the motor 257 and controls the race as a whole, the receiving unit 255 for receiving the car driving start signal, the lamp flashing signal and the car acceleration signal from the remote controller 300 and inputting to the control unit 254, a power supply unit 256 for supplying the power to the control unit and supplying additional power to increase the speed of the motor 257, a motor 257 for rotating to enable driving the car on the lane 100, a display unit 258 for displaying the driving state of the car, and a switch 259 for setting the car driving state displaying through the display unit 258.

The motor 257 is connected wheels 251 to act each other.

The motor 257 initially rotates at a constant speed according to a signal received from the remote controller 300, and when a signal is received again from the remote controller 300, the motor 257 speeds up so that the car catches up with the car in front.

The wheel 251 is configured to avoid the first locking device 225 and the second locking device 235 so as not to interfere with the driving of the car, and so that the car body can be maintained at a certain height from the bottom surface of the lane 100.

With this configuration, it is possible for the first part 210 of the other car driving behind to enter under the body of the car driving in front by a certain amount. That is, the heights of the first part 210, the second part 220, and the third part 230 are set so that the first part 210 can enter almost to the second part 220.

As shown in FIG. 6, the power supply unit 256 is a DC battery, and may basically consist of two batteries and one LR44 booster battery for acceleration.

When the second switch 320 configured in the remote controller 300 is pressed for the first time, two batteries provide driving power to the motor 257 so that the car starts driving, so that the car 200 moves along the lane 100 at a predetermined speed. When the second switch 320 is pressed again, the booster battery provides acceleration power to the motor 257 so that the car 200 drives along the lane 100 at an accelerated speed and the car 200 can catch up the car in front within a certain distance.

The signal transmitted from the remote controller 300 is processed by the control configuration shown in FIG. 8 to enable driving of the car 200.

When the signal transmitted from the remote controller 300 is received and input by the receiver 255, the control unit 254 processes the signal and increases the speed of the motor 257, thereby controlling the driving speed of the car 200 to become faster. That is, it is controlled to increase the speed for a certain period of time. To this end, the control unit 254 and the remote controller 300 are set to match the same frequency.

The controller 254 includes a timer so that the acceleration signal received from the remote controller 300 is not repeatedly applied within a predetermined time. In other words, it is controlled so that the speed can be increased again only after a certain period of time has elapsed.

The remote controller 300 is a control unit that transmits a signal to the car 200 so that the car 200 can run on the lane 100, and as shown in FIG. 9, comprises a first switch 310 and a second switch 320, a lamp 330, a transmission unit 340, and a control unit 350.

The first switch 310 sets the blinking count (pattern) of the remote controller lamp 330, which is set equal to the blinking count of the lamp (display unit 255) by the switch 259 configured in the car 200. That is, when the number of pressing of the first switch 310 and the switch 259 of the car are the same, the number of blinking of the remote controller lamp 330 and the controller display unit 258 becomes the same.

The second switch 320 performs an operation for starting driving of the car 200 and an operation for accelerating the car 200. That is, when the second switch 320 is operated for the first time, the car 200 starts driving and travels along the lane 100, and when operated again, the car 200 accelerates for a certain period of time.

Such an operation is possible by a program stored in the control unit 254 of the control device and the control unit 35 of the remote controller 300. Of course, even if the second switch 320 is continuously operated as described above, the control unit 254 controls it so that it does not accelerate again within a certain period of time that has been pressed for acceleration, and it must be operated after a certain period of time has elapsed so that acceleration is possible again.

The overall operational flow of the car racing system of the present invention configured as described above will be described with reference to FIG. 10.

First, it is determined whether initialization has been performed (S10).

If the initialization is performed in the step S10, it is determined whether the car driving setting is completed (S30). This operation is possible by the configuration shown in FIGS. 8 and 9. That is, the player manipulates the first switch 310 of the remote controller 300 and the switch 259 of the car 200 so that the blink operation of the lamp 330 of the remote controller 300 and the blink operation of the display unit 258 of the car 200 are same.

If the car driving setting is not completed in the above step (S30), it waits.

On the other hand, if the car driving setting is completed in step S30, the player operates the second switch 320 of the remote controller 300 so that the car driving start signal is sent to the control device of the car 200 through the transmitter 340.

Therefore, the car 200 control device receives the car driving start signal from the receiver 255 and inputs the signal to the controller 254, and the controller 254 controls the motor 257 to rotate at a constant speed while driving the car 200 on the lane 100. That is, the racing of cars begins (S110).

In this state, when the player manipulates the second switch 320 of the remote control 300 once again, this manipulation signal is transmitted to the control device of the car 200 through the transmitter 34.

The car control device controls that the signal transmitted from the remote control 300 is received by the receiver 255, the controller 254 determines that the signal is a car acceleration signal, and the power of the accelerator battery configured in the power supply unit 256 is applied to the motor 257 (S130).

Next, the car drives along the lane 100 at an accelerated speed and catches up with the driving in front, and the first part 210 is entered into the second part 220 through the third part 230 of the car in front.

Next, the first magnet 211 of the driving behind and the second magnet 239 of the car driving in front act (the second magnet is attracted to the first magnet), and the second locking device 235 is released from the first locking device 225. That is, the second locking device 235 operates because the second magnet 239 is attracted to the first magnet 211, and the second locking part 238 is released from the first locking part 226 (S170)

Next, because the second locking device 235 of the car driving behind releases the first locking device 225 of the car driving in front, and the first locking device 225 is released from the state of being elastically coupled to a certain part at a lower portion of the car by spring hinge S and unfolded at a right angle.

As the first locking device 225 is unfolded at right angles at the lower part of the car, the car loses its center of gravity and moves out of the lane 100 (S190).

Thereafter, the car race continues (S210).

Second Embodiment

FIG. 11 is a structure of a locking device according to a second embodiment of the present invention, showing a locked state. FIG. 12 is a structure of a locking device according to a second embodiment of the present invention, showing a unlocked state. FIG. 13 is a view showing a state in which a third locking device is rotated by elasticity by that the locking device according to a second embodiment of the present invention is unlocked. FIG. 14 is a view showing a spring member causing rotation of a third locking device by that the locking device according to the second embodiment of the present invention is unlocked.

It is to be understood that the locking device in the second embodiment is similar to the configuration except for the magnet in the first embodiment.

The third locking device 500 is configured on the bottom surface of the second part 220 of the car body, and is in close contact with the bottom surface of the car body, and then unlocked by the fourth locking device 600 of the other vehicle, it operates (rotates) elastically, and accordingly, the car body is lifted upward and loses its center so that the car departures from the lane 100.

In order to enable elastic operation, the third locking device 500 may be coupled to a certain portion of the bottom surface of the car body via a spring hinge 700 as shown in FIG. 14. The spring hinge 700 has the same structure as the spring hinge P of FIG. 1.

When the third locking device 500 is unlocked in a state that the third locking device 500 is elastically coupled to a certain lower part of the second part 220 by the spring hinge 700, the third locking device 500 is unfolded (rotated) at right angles, the car body is lifted upwards at a certain height from the lane 100, and the car body, which is driving, loses its center of gravity and tilts, departing from the lane 100.

The spring hinge 700 is an example, and there is no limit any construction if the third locking device 500 is elastically coupled to the bottom surface of the car body of the second part 220, and if third locking device 500 can be operated by a predetermined angle.

For example, if a hinge for opening and closing is formed on one side of the third locking device 500, and at a part where a spring hinge is formed, and a spring member having a certain elasticity is fixed and attached close to the hinge. Therefore, when the third locking part 520 and the fourth locking part 620 are engaged with each other and the spring is compressed, and then the third locking part 520 and the fourth locking part 620 are released, the third locking device 500 is unfolded at a predetermined angle, such as 90° so that the car can be departed from the lane while soaring upward.

The third locking device 500 is configured in a size that does not exceed the width (left and right width) of the car 200, and a third locking portion 520 that is locked or released by the fourth locking device 600 in a certain portion is formed in a certain shape.

The fourth locking device 600 is configured on the bottom surface of the third part 230 and is configured to move through a shaft 610 formed on the bottom surface of the car body. At one end of the fourth locking device 600 a fourth locking portion 620 is configured which is locked or released by the third locking portion 520 of the third locking device 500. At the other end of the fourth locking device a pressing portion 630 is configured which is pressed by the front end portion 215 of the first portion 210 of the car body.

The fourth locking device 600 is formed in a shape as shown in FIG. 12. The fourth locking device operates that the third locking part 520 and the fourth locking part 620 are smoothly released while being rotated clockwise about the shaft 610 when the pressing portion 630 is pressed by the tip part 215. The shaft 610 has a structure similar to the shaft 237 of the first embodiment, and may be configured such that a member capable of fixing one end of the shaft to a part of the bottom surface of the car body is formed and coupled to the member.

The fourth locking part 620 is securely fixed (locked) to the third locking part 520 at normal times, that is, when a car driving behind does not approach closely and when the front end 215 of the first part of the car driving behind applies an impact to the pressing part 630, the locking release is easily performed.

That is, the fourth locking part 620 is configured in a shape having a certain curved surface so that unlocking from the third locking part 520 is smoothly performed, and the third locking part 520 corresponding to this is formed so that the release of the fourth locking part 620 is smoothly performed. The third locking part 520 and the fourth locking part 620 are formed in the same structure as the first locking part 226, the second locking part 238, and the curved surface part 227 of the first embodiment.

INDUSTRIAL APPLICABILITY the present invention provides a car racing system that a player can enjoy a car racing game realistic and thrilling like a real car race using a controller (remote controller) and a car behind let a car in front out of a lane by accelerating.

The invention claimed is:

1. A car racing system, comprising:

a lane (100) configured for car racing;

a first car and a second car identical in structure, each car including:

a car body having a first part (210) at a front end of the car body, a second part (220) at a middle portion of the car body, and a third part (230) at a rear end of the car body;

a first magnet (211) disposed at the first part of the car body;

a first locking device (225) coupled to a bottom surface of the car body, the first locking device including a first locking portion (226); and a second locking device (235) movably mounted in the car body, the second locking device including at one end a second magnet (239) and at an opposite end a second locking portion (238) that engages the first locking portion (226) of the first locking device to lock the first locking device; and a remote controller (300) for controlling at least one of the first car and the second car, wherein as the first car approaches the second car from behind such that the first magnet (211) of the first car is brought into proximity with the second magnet (239) of the second car, the second magnet (239) of the second car is magnetically attracted to the first magnet (211) of the first car, causing the second locking device (235) of the second car to disengage the second locking portion (238) from the first locking portion (226) of the second car's first locking device (225), thereby releasing the first locking device of the second car and lifting the second car upward off the lane.

2. The car racing system of claim 1, wherein:

the first locking device (225) of each car is coupled to a bottom surface portion of the car body via a spring hinge to permit elastic movement, the first locking device having a first locking portion (226) engageable with a second locking portion (238) of the second locking device (235); and the second locking device (235) of each car is disposed in a housing body (236) defining an internal space and is configured to move along a shaft (237) within the housing body (236), the second locking device having the second locking portion (238) at one end engageable with the first locking portion (226) of the first locking device and the second magnet (239) at an opposite end positioned to be attracted by the first magnet (211).

3. The car racing system of claim 1, wherein each of the first car and the second car further includes:

a control unit (254) configured to process signals from the remote controller (300) to increase a rotational speed of a motor and to control the race as a whole;

a receiving unit (255) configured to receive a car driving start signal, a lamp-flashing signal, and a car acceleration signal from the remote controller and to provide the same signals to the control unit;

a motor (257) operative to drive each car on the lane;

a power supply unit (256) for supplying power to the control unit and providing additional power to increase the speed of the motor;

a display unit (258) for displaying a driving state of each car; and a switch (259) for setting the driving state of each car that is displayed via the display unit.

4. The car racing system of claim 1, wherein the remote controller (300) includes:

a first switch (310) configured to set a blinking pattern of a lamp on the remote controller to match a blinking pattern of a lamp on a selected one of the cars, wherein the blinking pattern of either one of the car's lamp is set by the switch (259) on each car; and a second switch (320) configured to be actuated to initiate driving and to accelerate the selected car.

* * * * *